US006592276B2

(12) United States Patent
Ohba et al.

(10) Patent No.: US 6,592,276 B2
(45) Date of Patent: Jul. 15, 2003

(54) PRINTER FOR FORMING AN IMAGE ON A TRANSPORTED WEB

(75) Inventors: Tetsuya Ohba, Hitachinaka (JP); Tsukasa Onose, Hitachinaka (JP); Takeshi Terakado, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 33 days.

(21) Appl. No.: 09/785,284

(22) Filed: Feb. 20, 2001

(65) Prior Publication Data

US 2001/0024589 A1 Sep. 27, 2001

(30) Foreign Application Priority Data

Mar. 24, 2000 (JP) ..... 2000-083450
Sep. 14, 2000 (JP) ..... 2000-279071

(51) Int. Cl.[7] ..... B41J 11/42

(52) U.S. Cl. ..... 400/582; 400/583; 400/618; 400/592; 101/484

(58) Field of Search ..... 400/582, 583, 400/618, 619, 592, 607.3, 608.2, 611, 500; 101/484

(56) References Cited

U.S. PATENT DOCUMENTS 4,011,976 A 3/1977 Greer
4,838,498 A * 6/1989 Huth ..... 242/75.51
5,072,671 A * 12/1991 Schneider et al. ..... 101/467
5,774,777 A 6/1998 Ohtsuka et al.
5,967,394 A * 10/1999 Crowley et al. ..... 226/31
6,052,144 A * 4/2000 Reyner ..... 347/262
6,106,177 A * 8/2000 Siegl et al. ..... 400/618
6,305,857 B1 * 10/2001 Crowley et al. ..... 400/579
6,321,650 B1 * 11/2001 Ogawa et al. ..... 101/227

FOREIGN PATENT DOCUMENTS

DE 44 00 965 C1 8/1995
DE 197 49 651 A1 6/1999
JP 57-144780 9/1982

* cited by examiner

*Primary Examiner*—Andrew H. Hirshfeld
*Assistant Examiner*—Darius N. Cone
(74) *Attorney, Agent, or Firm*—Antonelli, Terry, Stout & Kraus, LLP

(57) ABSTRACT

A printer capable of stably transporting a web at high speed and with a high accuracy has a printing unit (10) for forming images on a web (W); a yet-to-be-printed web control means (2, 3, 5) for controlling the traveling position and tension of the web at a position upstream in a web transporting direction of the printing unit; and an after-printed web control means (12, 13*b*, 13*c*, 13*d*) for controlling the traveling position and tension of the web at a position downstream in the web transporting direction of the printing unit.

6 Claims, 2 Drawing Sheets

PRINTER FOR FORMING AN IMAGE ON A TRANSPORTED WEB

BACKGROUND OF THE INVENTION

The present invention relates to a printer for forming images on a web transported at high speed; and, more particularly, the invention relates to a printer capable of stably transporting a web at high speed, even if a web having no feeding perforations is used.

In a printer capable of forming images on a web, in general, the web is transported by engaging pin members of a tractor mechanism mounted on the printer with feeding perforations disposed along the margins of the web. The tractor mechanism is then driven, and, at the same time, images are formed on the web at an image forming portion of the printer. However, in the case of printing on a web with feeding perforations, work for cutting off the perforated portions (usually, both marginal edge portions in the width direction of the web) from the web is necessary after the printing, and, accordingly, it takes an additional time to obtain the final printed matter. Further, the printer inevitably must be equipped with a tractor mechanism, which makes the structure of the printer complex. The cutting-off work described above can be eliminated by employing a web without feeding perforations and by changing the web transporting unit in the printer from that of a tractor mechanism to that of a transporting roller mechanism.

In a printer which forms images on a web that does not have feeding perforations, such as by transporting the web using a transporting roller mechanism, if the printer is a printer operating in a middle speed range up to a speed equivalent to the transporting speed of 50 pages/minute of A4-size paper in landscape configuration, significant slipping does not occur between the web and the transporting roller, and printing with little misalignment of position can be performed.

However, in a printer operating in a high speed range having a printing speed above 100 pages/minute, or in a printer operating in an ultra-high speed range having a printing speed above 200 pages/minute, using the conventional structure, it is difficult to correctly transport the web to the printing portion. Therefore, it is necessary to highly accurately control the tension and the traveling position of the web during transporting of the web.

SUMMARY OF THE INVENTION

An object of the present invention is to provide a printer which is capable of stably transporting a web at high speed and with high accuracy.

The above object can be attained by a printer for forming an image on a transported web, which comprises a printing unit for forming the image on the web; a yet-to-be-printed web control means for controlling the traveling position and the tension of the web at a position upstream in a web transporting direction of the printing unit; and an after-printed web control means for controlling the traveling position and the tension of the web at a position downstream in the web transporting direction of the printing unit.

DESCRIPTION OF THE PREFERRED EMBODIMENTS

Figure 1:
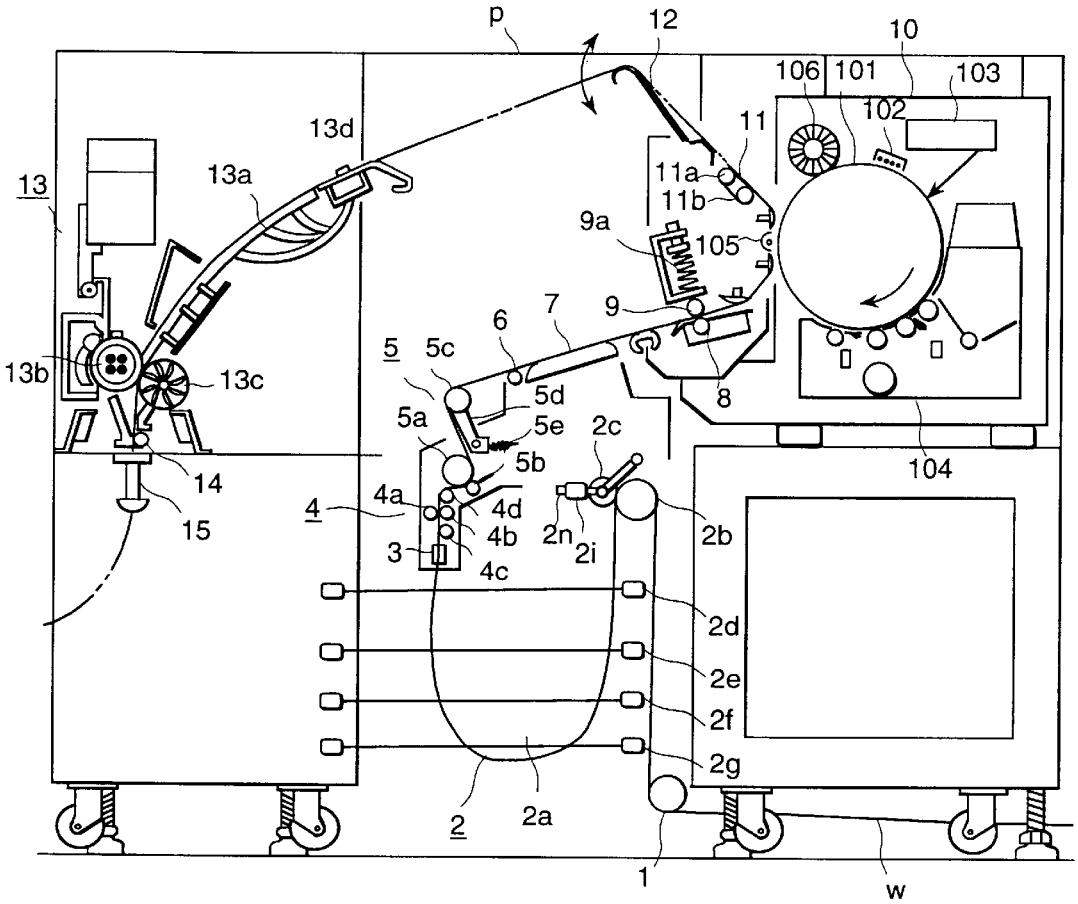
FIG. 1 is a diagram showing a side view of the overall structure of an embodiment of a printer in accordance with the present invention.

An embodiment of the present invention will be described with reference to the accompanied drawings. FIG. 1 is a schematic view showing an embodiment of a printer in accordance with the present invention.

In FIG. 1, the reference character W denotes a web. In the printer, the web W is usually made of paper in most cases, but it is not limited to paper. In some cases, the web is a plastic film. The web is sent out from a feeder (not shown), and passes under a printer P so as to be fed into the printer P.

The web W fed into the printer P is guided by a guide roller 1 arranged on a transporting path so as to be transported toward a web buffer mechanism 2. The guide roller 1 does not have any driving mechanism, but is a driven roller which is rotated by contacting the transported web W.

The web buffer mechanism 2 comprises an accumulation part 2*a* for temporarily accumulating the transported web W; a pair of rollers 2*b*, 2*c* arranged upstream in the web transporting direction relative to the accumulation part 2*a;* and a plurality of sensors (in this embodiment, four pairs of optical sensors 2*d*, 2*e*, 2*f*, 2*g* are used) for monitoring the amount (a buffer amount) of slack in the web in the accumulation part 2*a*. Therein, the roller 2*b* is a driving roller connected to a drive mechanism (not shown), and the roller 2*c* is a driven roller not having any drive mechanism. Further, the roller 2*c* is equipped with a control mechanism for controlling the pressing force of the roller 2*c* against the roller 2*b*. In the control mechanism of the present embodiment, a weight 2*i* is slidably arranged in a shaft 2*h* projecting from one end of the roller 2*c*, and the pressing force of the roller 2*c* against the roller 2*b* is controlled by changing the position of the weight 2*i*, that is, by using the principle of leverage.

In the accumulation part 2*a*, the buffer amount is always monitored so that the bottom face of the slacked web W is kept at the level of the sensor 2*f*. When the bottom face of the web W comes to the level of the sensor 2*g*, as shown in the figure, the rotation of the roller 2*b* is controlled so as to be slowed down so that the bottom face of the web W may be raised up to the level of the sensor 2*f*. On the contrary, when the bottom face of the web W comes to the level of the sensor 2*e*, the rotation of the roller 2*b* is controlled so as to be speeded up so that the bottom face of the web W may be lowered down to the level of the sensor 2*f*. Even if the rotation control of the roller 2*b* described above is performed, there are some cases where the web W can not be returned to the level of the sensor 2*f* due to wearing of the roller 2*b* or the roller 2*c*, or erroneous control of the pressing force. Particularly, when the buffer amount is decreasing, the tension on the web is increasing, tending to cause rupture of the web being transported. In order to prevent such an event, when the bottom face of the web W reaches the level of the sensor 2*d*, transportation of the web is forced to be stopped.

Figure 2:
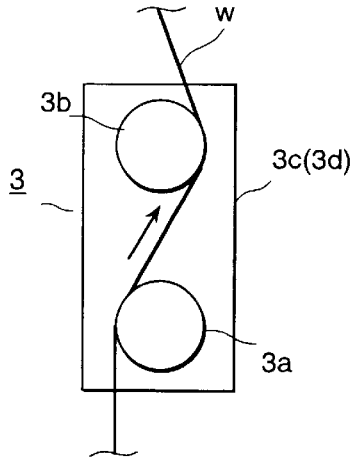
FIG. 2 is a schematic side view showing an example of a guide means used in the printer in accordance with the present invention.
Figure 3:
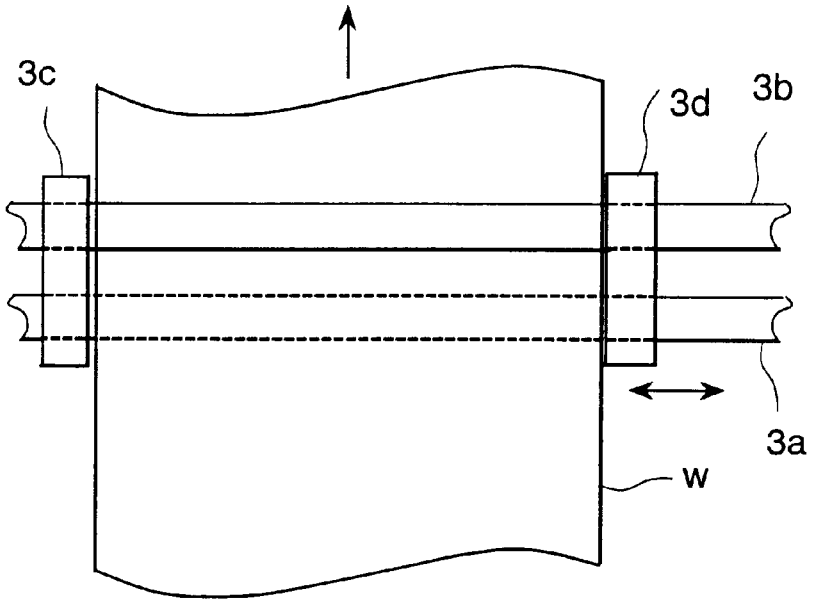
FIG. 3 is a schematic front view showing the example of the guide means used in the printer in accordance with the present invention.

A guide member 3 for restricting the edge position of the web W being transported is arranged in the web outlet portion of the accumulation part 2*a*. The guide member 3 has two fixed shafts 3*a*, 3*b*, and the web W passing through the guide member 3 is transported while passing between the shaft 3*a* and the shaft 3*b*, as shown in FIG. 2. Restricting members 3*c*, 3*d* for restricting the positions in the width direction (the direction perpendicular to the transporting direction) of the web W being transported are arranged on the two shafts 3*a*, 3*b*. Therein, it is preferable that both of or one of the restricting members 3*c*, 3*d* is arranged movably along the axial direction of the shafts 3*a*, 3*b*. That is, making the restricting members 3*c*, 3*d* movable means that the size of the web used in the printer is not limited, and, accordingly, the printer can use various kinds of webs. In the present embodiment, as shown in FIG. 3, the restricting member 3*c* is arranged so as to be fixed at a constant position, and the restricting member 3*d* is moveable corresponding to the width of the web W. Since the guide member 3 acts on the web W in the slack state at the accumulation part 2*a*, as described above, the traveling position of the web W coming in contact with the guide member 3 can be easily corrected.

Next, the web W which has passed through the guide member 3 is fed into an extraneous substance removing mechanism 4. The extraneous substance removing mechanism 4 has a pair of fixed shafts 4*a*, 4*b*, and fixed shafts 4*c*, 4*d* arranged at positions upstream and downstream of the shafts 4*a*, 4*b*, respectively. Therein, the shaft 4*a* and the shaft 4*b* are arranged so as to form a predetermined very narrow gap between them. There are some cases where extraneous substances, such as paper powder, dust and the like, are attached on the transported web W. If the web W having a nodule of extraneous substance is sent into the printing unit, the structural parts of the printing unit (for example, a photosensitive body) may be damaged. The narrow gap is provided to prevent such extraneous substances from entering into the printing unit. Therefore, for example, when an extraneous substance is firmly attached onto the web surface and the extraneous substance can not be peeled off from the web surface even when passing through the narrow gap, the web W is broken off at that position to prevent the structural parts of the printing unit from being damaged. The narrow gap in the present embodiment is set to about 0.5 mm, but the dimension is not limited to this value and may be set to an appropriate value depending on a thickness of the web used or the shape and structure of the transporting path. The shaft 4*c* and the shaft 4*d* arranged at the positions before and after the shafts 4*a*, 4*b* serve as guide members for guiding the web W to the narrow gap.

After having passed through the extraneous substance removing mechanism 4, the web W is fed into a tension adding mechanism 5. The tension adding mechanism 5 is composed of a drum 5*a* without any driving mechanism; a roller 5*b* arranged so as to be pressed toward the drum 5*a*; and a drum 5*c* movably supported on the web transporting path. Therein, the drum 5*a* may be a fixed drum, or it may be a drum driven by contact with the web W being transported. The roller 5*b*, which is pressed toward the drum 5*a*, is provided as a driven roller, and the roller in this embodiment has a structure such that it is composed of a plurality of sections divided in the width direction of the web W. The drum 5*c* is fixed to a free end of a movably supported arm 5*d*, and it is pressed toward the surface of the web W by a spring 5*e*. By providing the tension adding mechanism 5, the tension of the web W can be maintained constant.

The web W which has passed through the tension adding mechanism 5 is fed into the printing unit 10 by transporting rollers 8, 9 after passing over a guide shaft 6 and a guide plate 7.

In the printing unit 10, for example, a printer of an electrophotgraphic recording type is used. When a photosensitive drum 101 representing an example of an image holding body is started to be rotated, a high voltage is applied to a corona charger 102 to uniformly charge the surface of the photosensitive drum 101. Light output from a light source 103 composed of a semiconductor laser or a light emitting diode image-exposes the surface of the photosensitive drum 101 to form an electrostatic latent image on the photosensitive drum 101. When the area of the photosensitive drum 101 holding the electrostatic latent image reaches a position opposite to a developing unit 104, a developing agent is supplied to the electrostatic latent image to form a toner image on the photosensitive drum 101. The toner image formed on the photosensitive drum 101 is attracted onto the web W by the action of a transfer unit 105, which adds a charge having an inverse polarity relative to the toner image onto the back side surface of the web W. The area which has passed through the transfer position of the photosensitive drum 101 is cleaned by a cleaning unit 106 so as to be ready for the next printing operation.

The web W having the toner image transferred from the printing unit 10 in the manner as described above is transported to an after stage by a transporting belt 11. Therein, in regard to transporting rollers 8 and 9, the transporting roller 8 is a driving roller connected to a driving mechanism, and the transporting roller 9 is a driven roller pressed toward the transporting roller 8 and against the web W by the elastic force of a spring 9*a*. Further, the transporting belt 11 is stretched between and supported by a driving roller 11*a* and a driven roller 11*b*, and it has a vacuum unit (not shown) to aid in the transport of the web W by causing the back surface of the web W to stick on the transporting belt 11.

The web W sent out from the transporting belt 11 is transported to a fixing unit 13. through a buffer plate 12. The web W arriving at the fixing unit 13 is pre-heated by a pre-heater 13*a*, and then it is transported by a nip part formed of a pair of fixing rollers composed of a heating roller 13*b* and a pressing roller 13*c* to melt and fix the toner image on the web W.

The web W sent out by the heating roller 13*b* and the pressing roller 13*c* passes by a sending roller 14, and it is alternately folded by pendulum action of a swing fin 15 so as to be stacked inside the printer P, or it is taken out of the printer P as shown by the break line so as to be subjected to appropriate processes, such as cutting, stapling, punching and so on in an after-processing unit (not shown). Thus, the series of operations is completed.

In FIG. 1, the above-mentioned buffer plate 12 is used for absorbing slack or tension produced in the web W when a transporting speed difference occurs between the transporting belt 11 and the fixing rollers 13*b*, 13*c*. When the buffer plate 12 is tilted toward the upper side from a preset neutral position of the buffer plate 12, the heating roller 13*b* is controlled so as to be rotated at a higher speed so that the buffer plate 12 is moved down to the neutral position. On the contrary, when the buffer plate 12 is tilted toward the lower side from the neutral position, the heating roller 13*b* is controlled so as to be rotated at a slower speed so that the buffer plate 12 is moved up to the neutral position. As described above, the control system is constructed so that a constant tension is applied to the web W.

Figure 4:
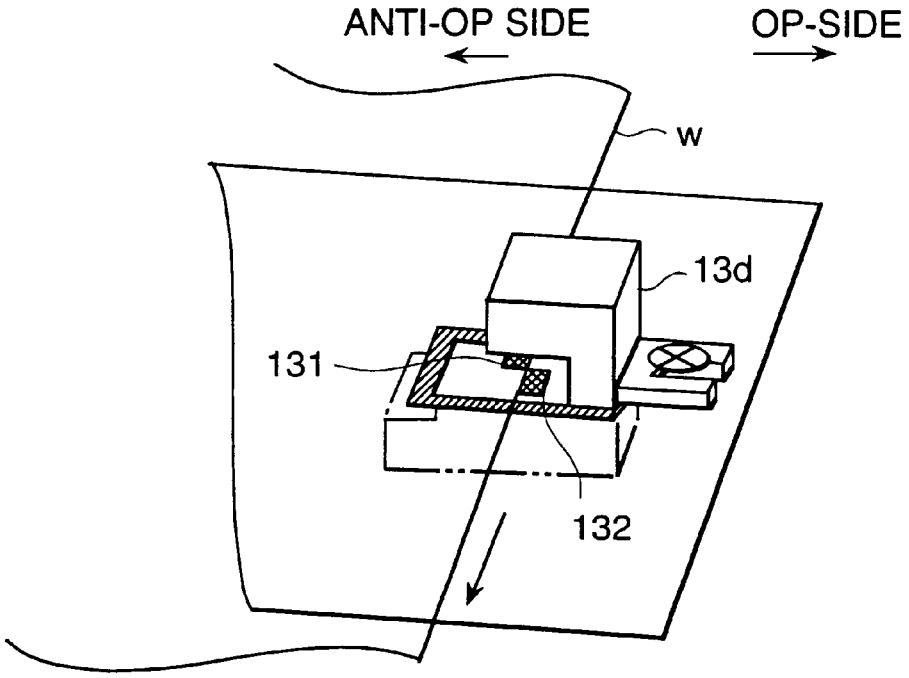
FIG. 4 is a schematic perspective view showing an example of an edge detection means used in the printer in accordance with the present invention.

The reference character 13*d* indicates a sensor for detecting meandering of the web W. In the printer of the present embodiment, the web having no feeding perforations along the marginal edges in the web width direction are used. Therefore, the sensor 13*d* detects an amount of meandering based on the edge position of the web, as shown in FIG. 4.

For example, the sensor 13*d* has shading amount detection portions 131 and 132 at positions on the both edge boundaries of the web W at the printer front side (hereinafter, referred to as the "OP side") and at the printer rear side (hereinafter, referred to as the "anti-OP side"), respectively. In each of the shading amount detection portions 131, 132, an LED and a photo-diode (outputting a linear voltage corresponding to an amount of received light) are arranged opposite to each other, and the position of the web W existing between them is detected from the shading light amount. The traveling position of the web W in a meandering state is corrected by varying the pressing forces on one side and on the other side of the pressing roller 13*c* relative to the heating roller 13*b* corresponding to the output from the sensor 13*d*.

As described above, since the printer in accordance with the present invention comprises a yet-to-be-printed web control means for controlling the traveling position and the tension of the web at a position upstream in a web transporting direction of the printing unit, and an after-printed web control means for controlling the traveling position and the tension of the web at a position downstream in the web transporting direction of the printing unit, the web can be stably transported at high speed and with a high accuracy, and a good image without blur can be formed on the web.

What is claimed is:

1. A printer for forming an image on a transported web, which comprises:

a printing unit for forming the image on said web;

a web buffer means having an accumulation part for giving slack to said web, said accumulation part being arranged at a position upstream of said printing unit in a web transporting direction, a slack amount detection means for detecting an amount of slack of said web in said accumulation part and a bringing-in means for bringing said web into said accumulation part;

a tension adding means for adding a tension to said web, said tension adding means being arranged between said printing unit and said web buffer means;

a guide means for moving said web in a direction perpendicular to the web transporting direction before introducing said web into said tension adding means to correct a traveling position of said web;

a first transporting mechanism for transporting said web, said first transporting mechanism being arranged between said tension adding means and said printing unit;

a second transporting mechanism for transporting said web which has passed through said printing unit;

a third transporting mechanism arranged at a position downstream in the web transporting direction of said second transporting mechanism;

a buffer mechanism for absorbing slack or tension in the web due to difference between web transporting speeds of said second transporting mechanism and said third transporting mechanism, said buffer mechanism being arranged between said second transporting mechanism and said third transporting mechanism displaceably to a web transporting path;

an edge detection means for detecting an edge position in a width direction of said web;

a first control means for controlling an amount of web brought in by said bringing-in means based on an output of said slack amount detection means;

a second control means for controlling an amount of web transported by said third transporting mechanism based on displacement information of said buffer mechanism; and a third control means for correct meandering of the web based on an output of said edge detection means.

2. A printer according to claim 1, which comprises an extraneous substance removing means for removing an extraneous substance attached onto surfaces of said web, said extraneous substance removing means being arranged between said guide means and said tension adding means.

3. A printer for forming an image on a transported web, which comprises:

a transfer means for transferring a toner image formed on an image holding body to said web;

a web buffer means having an accumulation part for giving slack to said web, said accumulation part being arranged at a position upstream of a printing unit in a web transporting direction, a slack amount detection means for detecting an amount of slack of said web in said accumulation part and a bringing-in means for bringing said web into said accumulation part;

a tension adding means for adding a tension to said web, said tension adding means being arranged between said printing unit and said web buffer means;

a guide means for moving said web in a direction perpendicular to the web transporting direction before introducing said web into said tension adding means to correct a traveling position of said web;

a transporting roller mechanism for transporting said web while putting said web between rollers, said transporting roller mechanism being arranged between said tension adding means and said transfer means;

a transporting belt mechanism for transporting said web which has passed through said transfer means while holding a back surface of said web;

a fixing means having a pair of fixing rollers pressing to each other, said fixing means fixing the toner image transferred on said web to said web;

a buffer mechanism for absorbing slack or tension in the web due to difference between web transporting speeds of said transporting belt mechanism and said fixing means, said buffer mechanism being arranged between said transporting belt mechanism and said fixing means displaceably to a web transporting path;

an edge detection means for detecting an edge position in a width direction of said web;

a first control means for controlling an amount of web brought in by said bringing-in means based on an output of said slack amount detection means;

a second control means for controlling an amount of web transported by said fixing means based on displacement information of said buffer mechanism; and a third control means for correct meandering of the web by adjusting a pressing force in an axial direction of said fixing roller based on an output of said edge detection means.

4. A printer according to claim 3, which comprises an extraneous substance removing means for removing an extraneous substance attached onto surfaces of said web, said extraneous substance removing means being arranged between said guide means and said tension adding means.

5. A printer according to claim 1, wherein said web is a web without feeding perforations.

6. A printer according to claim 3, wherein said web is a web without feeding perforations.

* * * * *